US005414500A

United States Patent [19]

Furukawa

[11] Patent Number: 5,414,500

[45] Date of Patent: May 9, 1995

[54] IMAGE RECORDING APPARATUS

[75] Inventor: Satoshi Furukawa, Suzuka, Japan

[73] Assignee: Brother Kogyo Kabushiki Kaisha, Nagoya, Japan

[21] Appl. No.: 231,055

[22] Filed: Apr. 22, 1994

[30] Foreign Application Priority Data

May 20, 1993 [JP] Japan ..... 5-118708

[51] Int. Cl.[6] ..... G03G 15/06

[52] U.S. Cl. ..... 355/261; 347/158; 355/245

[58] Field of Search ..... 355/200, 210, 245, 260, 355/261, 262, 259; 346/153.1, 159, 160

[56] References Cited

U.S. PATENT DOCUMENTS 5,128,695 7/1992 Maeda ..... 346/159 X
5,153,611 10/1992 Kokado et al. ..... 346/159 X
5,191,170 3/1993 Yoshida et al. ..... 355/245 X
5,229,794 7/1993 Honma et al. ..... 346/159 X
5,233,392 8/1993 Kitamura ..... 355/261
5,283,594 2/1994 Iwao ..... 346/159
5,293,181 3/1994 Iwao et al. ..... 346/159 X
5,296,879 3/1994 Kagayama ..... 346/159 X
5,317,370 5/1994 Kohyama et al. ..... 355/245

*Primary Examiner*—A. T. Grimley
*Assistant Examiner*—Sandra L. Brasë
*Attorney, Agent, or Firm*—Oliff & Berridge

[57] ABSTRACT

In an image recording apparatus in which toner carried on a toner carry roller is supplied to an aperture electrode in contact with the aperture electrode, the aperture electrode is elastically supported through an electrode supporter formed of elastomer such as rubber, and the toner carry roller is designed in a barrel shape. Therefore, the contact pressure between the aperture electrode and the toner carry roller is constant over all positions due to the expanding action of the electrode supporter and the toner is uniformly supplied to all the apertures of the aperture electrode. As a result, a uniform-density toner image can be formed over all the positions.

19 Claims, 8 Drawing Sheets

IMAGE RECORDING APPARATUS

BACKGROUND OF THE INVENTION

1. Field of the Invention

The invention relates to an image recording apparatus equipped with means having an aperture portion that serves to modulate particle flow of charged toner and, particularly, to an image recording apparatus suitable for a copying machine, a printer, a plotter, a facsimile machine, or similar applications.

2. Description of Related Art

As one known image recording apparatus, there has been conventionally proposed an image recording apparatus in which an image signal is applied to an electrode having plural opening portions (hereinafter referred to as "apertures") to modulate the passage of toner particles through the apertures. An image is recorded on a support medium disposed on a counter electrode in accordance with the image signal. Such an image recording apparatus is disclosed in U.S. Pat. No. 3,689,935, for example. This image recording apparatus includes an insulator (insulating layer), a shielding electrode in the form of a continuous body which is disposed on one of the opposite surfaces of the insulating layer, and plural control electrodes which are insulated from one another and located on the other surface of the insulating layer. The apparatus also includes an aperture electrode unit having at least one row of apertures which are provided in correspondence with the respective control electrode so each aperture penetrates through the three layers of the insulating layer, the shielding electrode and an associated one of the control electrodes, a voltage applying means for applying selected electric potentials between the shielding electrode and each of the control electrodes, a toner carrier for supplying charged toner particles so that the flow of the toner particles passing through the apertures is modulated by the applied potentials, and means for moving the support medium relative to the aperture electrode unit to position the support medium in the path of flow of the toner particles.

In the conventional image recording apparatus as described above, the flow of the charged toner particles is controlled by the electric field inside the apertures. Thus, the electric field outside of the apertures is very weak. Accordingly, the toner particles supplied to the lower side of the apertures are attracted into the apertures by a weak electrostatic force, so that a flow amount of toner particles passing through the apertures per unit time is small, and the image forming speed is slow. Further, in order to improve controllability of the passage of the toner particles through the apertures, the electric field inside of the apertures must be intensified requiring an expensive high-voltage driving element.

SUMMARY OF THE INVENTION

In order to solve the above disadvantages, Japanese Patent Application No. 4-254494 (corresponding to U.S. patent application Ser. No. 08/112,471) has proposed an image recording apparatus in which an aperture electrode unit serving as toner-flow control means and a toner carrier serving as toner supply means are disposed in contact with each other. The toner flow is controlled by an electric field occurring between the toner carrier and the control electrodes of the aperture electrode unit to form an image. In this image recording apparatus, as the aperture electrode unit and the toner carrier are in contact with each other, excellent controllability of the toner particles is obtained, the image forming speed is high and a high quality image is obtained.

However, in the image recording apparatus as described above, contact pressure between the aperture electrode unit and the toner carrier is not uniform in the width direction thereof. This nonuniform contact pressure induces a new problem in that unevenness in the toner density occurs. Further, the nonuniform contact pressure between the aperture electrode unit and the toner carrier also induces "wrinkling" in the toner flow control means.

The invention has been implemented to solve the above problems. An object of the invention is to provide an image recording apparatus in which the contact pressure between the aperture electrode unit and the toner carrier is uniform over the overall portion and no unevenness in toner density occurs.

In order to attain the above object, the image recording device according to the invention includes toner flow control means for modulating at least toner flow, toner supply means having at least a toner supply member for supplying charged toner to the toner flow control means, and a counter electrode disposed at the opposite side of the toner supply means so as to confront the toner flow control means, wherein the toner flow control means and the toner supply member are disposed in contact with each other, and the toner supply member comprises a roller which is designed to be thicker at the middle portion than at both ends thereof (e.g., in a barrel shape).

Further, at least one of the toner flow control means and the toner supply member may be elastically supported by a housing so that it is elastically contacted with the other through the toner.

In the image recording apparatus according to the invention thus structured, the toner flow control means and the toner supply means are disposed in contact with each other, and the toner supply member comprises a roller which is designed to be thicker at the middle portion thereof than at both ends. Therefore, the contact pressure between the toner flow control means and the toner supply means is made uniform over all positions. In addition, no "wrinkling" due to an unevenness of pressure occurs in the toner flow control means. Accordingly, the toner can be supplied to the toner flow control means in a good condition while it is fed in contact with the toner flow control means and an image having uniform toner density over all positions can be formed.

As is apparent from the foregoing, according to the invention, the toner can be supplied to the toner flow control means in good condition and an image can be formed with uniform toner density over all positions using the image recording apparatus.

BRIEF DESCRIPTION OF THE DRAWINGS

A preferred embodiment of the invention will be described in detail with reference to the following figures wherein.

DETAILED DESCRIPTION OF THE PREFERRED EMBODIMENTS

Figure 1:
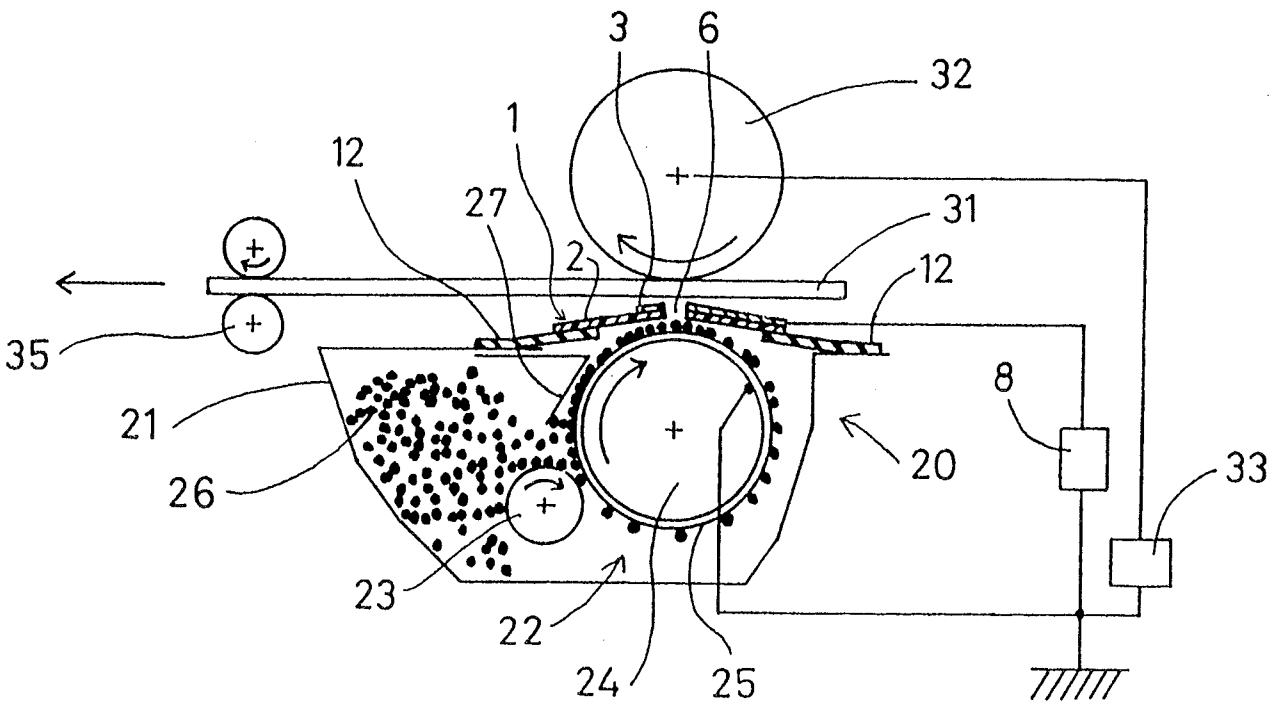
FIG. 1 is a cross-sectional view showing the structure of a first embodiment of an image recording apparatus of the invention.

Preferred embodiments according to the invention will be described hereunder with reference to the accompanying drawings.

In FIGS. 1 to 7, the same elements are represented by the same reference numerals.

FIG. 1 is a cross-sectional view showing a first embodiment of the image recording apparatus according to the invention. In FIG. 1, a counter electrode (back electrode) roller 32 is rotatably supported by a frame of the apparatus so as to be disposed at the upper side of an aperture electrode 1 serving as toner flow control means and spaced away from the aperture electrode 1 at a one millimeter interval. A support medium 31 is fed by rotation of the counter electrode roller 32. Further, a toner supply device 20 is disposed at the lower side of the aperture electrode 1 and a fixing device 35 is disposed at the downstream side in a feeding direction of the support medium 31.

The toner supply device 20 is structured as follows.

Figure 3:
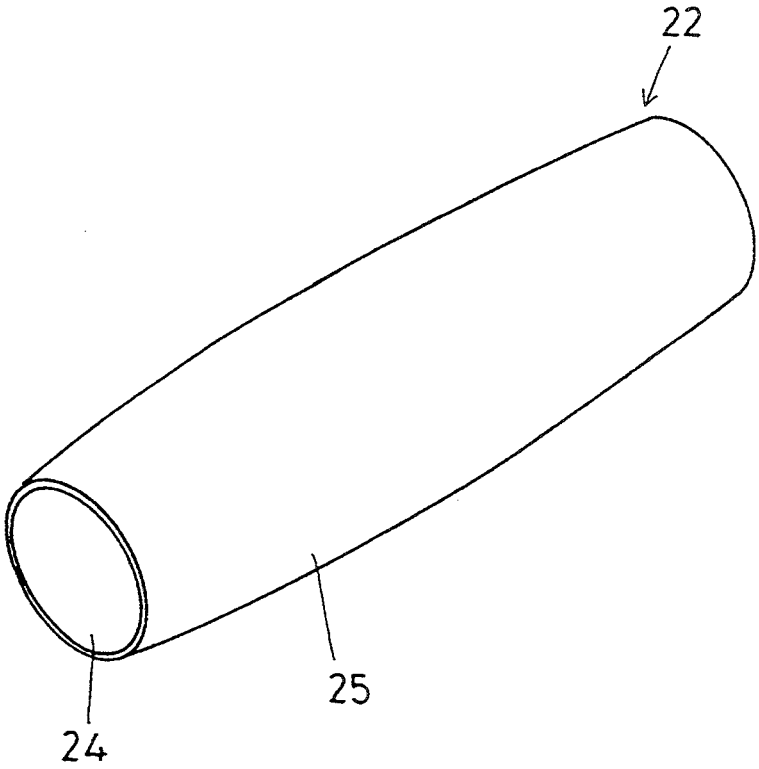
FIG. 3 is a detailed, perspective view of the structure of a toner carry roller used in the first embodiment.

In addition to toner 26, a supply roller 23 and a toner carry roller 22 are provided in a toner case 21. The supply roller 23 and the toner carry roller 22 are rotatably supported in parallel with each other. The toner carry roller 22 comprises a sponge roller 24 and a 20 μm-thickness sleeve 25 of nickel which is adhesively attached to the periphery of the sponge roller 24. The toner carry roller 22 has a barrel shape, that is, it is thicker (larger in diameter) at its middle portion than at both ends as shown in FIG. 3. The sleeve 25 is electrically grounded.

A non-magnetic, one-component type of insulating toner, having an average particle diameter of about 10 μm, is used as the toner 26 and normal fluidizing and charging control agents are added to the outside of the toner particles.

A toner-layer restricting blade 27 (hereinafter referred to as a "restrictor blade") is formed of an elastic material and is disposed to be pressed against the sleeve 25 on the toner carry roller 22. The restrictor blade 27 contacts the sleeve under the pressure of the elastic force of the restrictor blade 27 itself. As a result, a toner layer carried on the sleeve 25 is thinned by the restrictor blade 27.

The restrictor blade 27 may be formed of a rigid material. In this case, the tip of the restrictor blade 27 is formed in an arcuate shape which is coincident with the curved shape of the outer periphery of the toner carry roller 22. Accordingly, even when the toner carry roller 22 is designed in the barrel shape, the contact pressure between the restrictor blade 27 and the sleeve 25 is kept uniform over the overall outer periphery of the sleeve.

Figure 2:
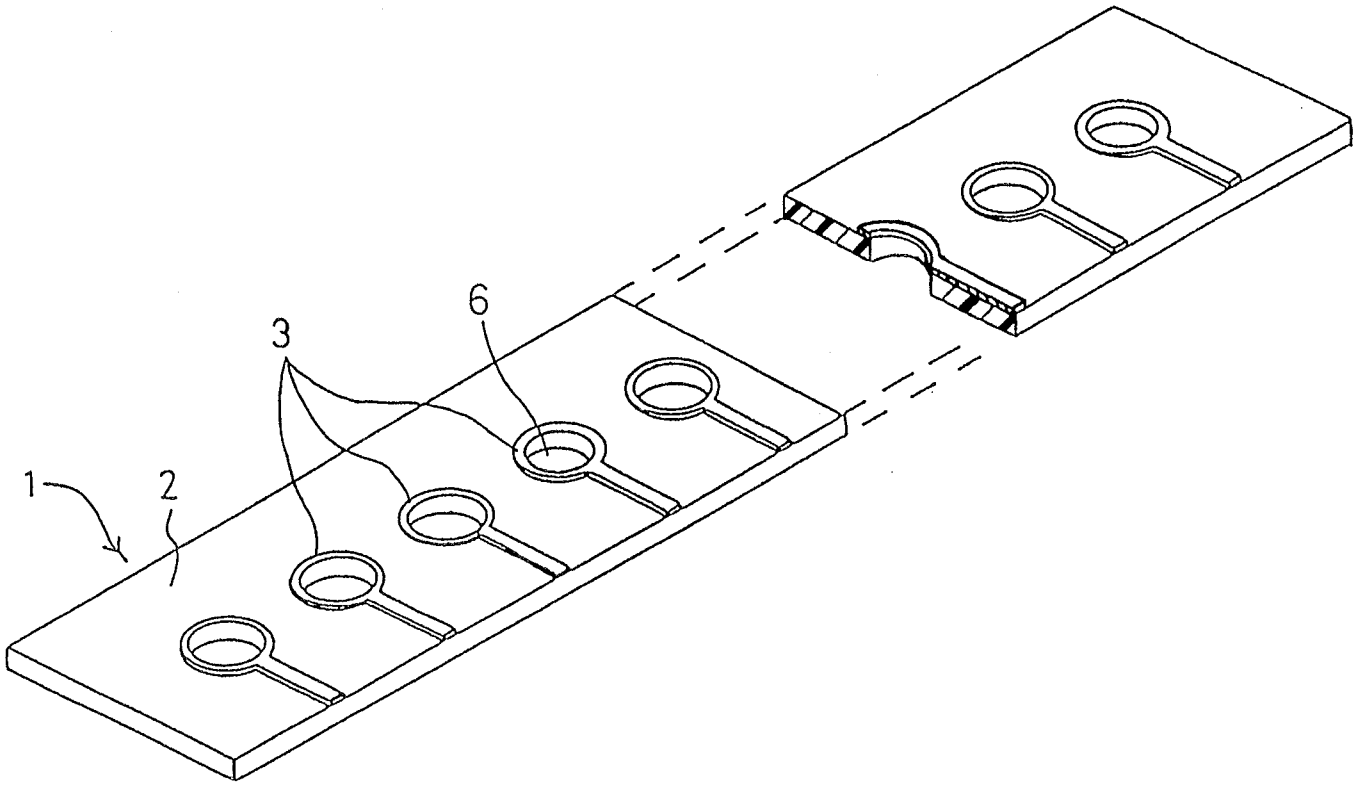
FIG. 2 is a detailed, perspective view of the structure of an aperture electrode used in the first embodiment.

As shown in FIG. 2, the aperture electrode 1 comprises a 30 μm-thick insulating sheet 2 of polyimide, at least one row of apertures 6 of 120 μm diameter which are formed in the insulating sheet 2, and control electrodes 3 each of which is disposed on one surface side of the insulating sheet 2 so as to surround an aperture 6.

The aperture electrode is disposed such that the control electrodes 3 face the back electrode roller 32 as shown in FIG. 1.

A control voltage applying circuit 8 is connected across the control electrodes 3 and the sleeve 25. The control voltage applying circuit 8 is designed to output a voltage of +40 V or −10 V in accordance with an image signal. A DC power source 33 for outputting a voltage of +1.5 kV is connected across the back electrode roller 32 and the sleeve 25.

Figure 8:
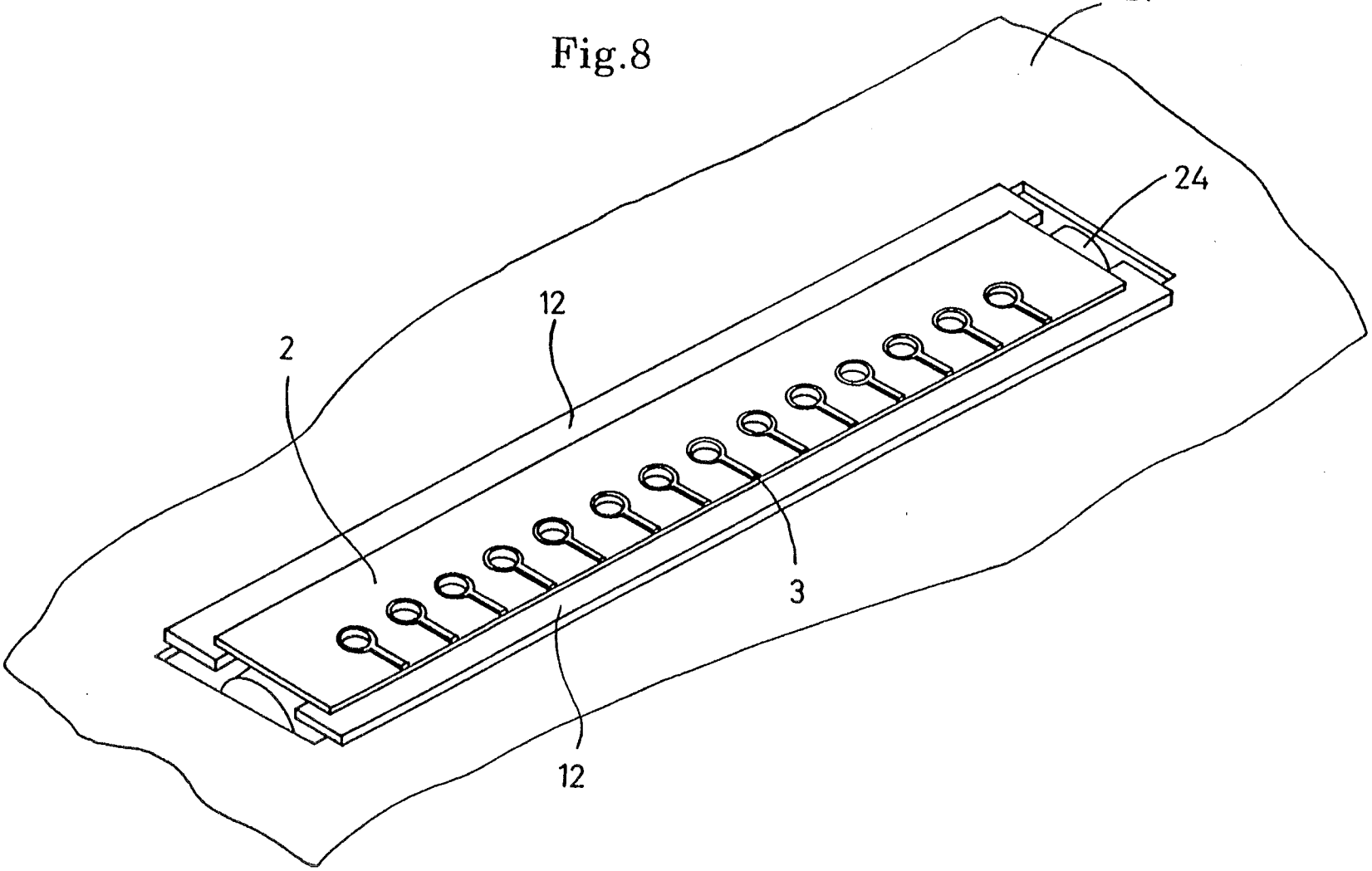
FIG. 8 is a oblique, top view of the first embodiment.

The aperture electrode 1 is fixed to a part of the toner case 21 through an electrode supporter 12 formed of an elastomer such as rubber. The toner carry roller 22 is disposed in the toner case 21 such that the electrode supporter 12 itself is pressed against the fixed aperture electrode 1. In this case, since the toner carry roller 22 is designed in a barrel shape, the contact pressure between the aperture electrode 1 and the toner carry roller 22 is constant over all positions by expanding and contracting, or widening and narrowing, action of the electrode supporter 12 to conform to the perturbations of the toner carry roller 22 (FIG. 8). Since the toner carry roller 22 is supported by the toner case at one end portion thereof, the contact pressure between the aperture electrode 1 and the toner carry roller 22 at the middle portion of the toner carry roller 22 is weaker than the contact pressure at the end portion due to flexibility of the roller. Accordingly, if the toner carry roller 22 is not designed in a barrel shape, the constant contact pressure cannot be obtained.

The operation of the image recording apparatus thus structured will be described.

By the rotation of the toner carry roller 22 and the supply roller 23 in the directions indicated by the arrows, the toner 26 is rubbed against the sleeve 25 of the toner carry roller 22 from the supply roller 23 to negatively charge the toner 26 and carry it on the sleeve. The toner 26 carried on the sleeve is thinned by the restrictor blade 27 and fed to a portion in the vicinity of the aperture electrode 1 by the rotation of the toner carry roller 22.

At this time, the toner on the sleeve 25 is supplied beneath the apertures 6 while being rubbed against the aperture electrode 1. The aperture electrode 1 and the sleeve 25 are spaced from each other at a 10 μm interval corresponding to the average particle diameter of the toner 26 in the toner layer.

The toner 26 carried on the sleeve 25 is provided with fluidity by adding a fluidizing agent to the outside of the toner 26. The toner 26 is then fed beneath the apertures 6 by the rotation of the toner carry roller 22 so that it is sandwiched between the aperture electrode 1 and the sleeve 25. At this time, the frictional resistance between the aperture electrode 1 and the sleeve 25 becomes constant because the pressure is constant over all positions as described above. Therefore, no unnecessary vibration occurs during the sliding operation of the aperture electrode 1 and the sleeve 25. In addition, the power requirement of the motor for driving the toner carry roller 22 having the sleeve 25 can be reduced. As a result, abrasion and damage to the sleeve 25 and the aperture electrode 1 can be prevented so that the lifetime of the sleeve 25 and the aperture electrode 1 can be lengthened.

The particle diameter of the toner 26 is substantially uniform over all the toner particles, and thus the gap interval between the aperture electrode 1 and the sleeve 25 can be kept constant at all times using no complicated mechanism. Further, the toner 26 is circulatingly and smoothly supplied to the portion in the vicinity of the apertures 6, so that the toner 26 which is about to be trapped in the apertures 6 can be scraped off by the circulated toner 26 itself. Therefore, the toner 26 clogging of the apertures 6 can be prevented and the occurrence of missing picture elements due to the clogging of the apertures 6 can be also prevented. In addition, the occurrence of noises and unevenness in the toner supply amount, which are caused by the erroneous passage of the toner 26 in a non-signal state due to toner dispersion can be prevented.

Here, the control electrodes 3 corresponding to an image portion are supplied with +40 V from the control voltage applying circuit 8 in accordance with the image signal. As a result, in the vicinity of the apertures 6 corresponding to the image portion, an electric line of force with a direction from the back electrode 32 side to the sleeve 25 side is formed due to the potential difference between the back electrode 32 and the sleeve 25. The negatively charged toner 26 is electrostatically attracted in the high-potential direction and is drawn from the surface of the sleeve 25, passed through the apertures 6 and then deposited on the support medium 31 to form an image.

At this time, since the contact pressure between the aperture electrode 1 and the sleeve 25 is uniform over all the positions, the toner 26 can be supplied to the aperture electrode 1 in a good condition and an image having uniform density over all the positions can be formed.

On the other hand, the control electrodes 3 corresponding to a non-image portion are supplied with −10 V from the control voltage applying circuit 8. As a result, the electric lines of force with a direction from the sleeve 25 to the control electrodes 3 is formed in the vicinity of the apertures 6, corresponding to the non-image portion, due to the potential difference between the control electrodes 3 and the sleeve 25. Since the potential between the sleeve 25 and the control electrodes 3 is decreasingly inclined from the sleeve 25 to the control electrodes 3, the negatively charged toner 26 is not passed through the apertures 6.

The support medium 31 is fed in a direction perpendicular to the row of the apertures 6 by a distance corresponding to the one picture element during a period for forming one-row of image. By repeating the above process during the feeding of the support medium 31 its entire length, a toner image can be formed over the entire surface of the support medium 31.

In the above process, the toner 26 is supplied to the apertures 6 in contact with the aperture electrode 1 at all times, and thus response is high. Further, the control electric field of the control electrodes 3 is formed between the control electrodes 3 and the sleeve 25 which are adjacent to each other. Thus, the control can be performed using a low control voltage.

Further, since the toner 26 is sliding along the control electrodes 3 of the aperture electrode 1, the toner 26 can be prevented from being trapped in the control electrodes 3 and clogging the apertures 6.

The invention is not limited to the above embodiments and various modifications may be made without departing from the subject matter of the invention.

For example, in the above embodiment, only the aperture electrode serving as the toner flow control means is elastically supported by the toner case serving as the housing. In place of this manner of support, the toner carry roller, serving as the toner supply member, may be elastically supported by the toner case or both the aperture electrode and the toner carry roller may be elastically supported by the toner case.

Figure 4:
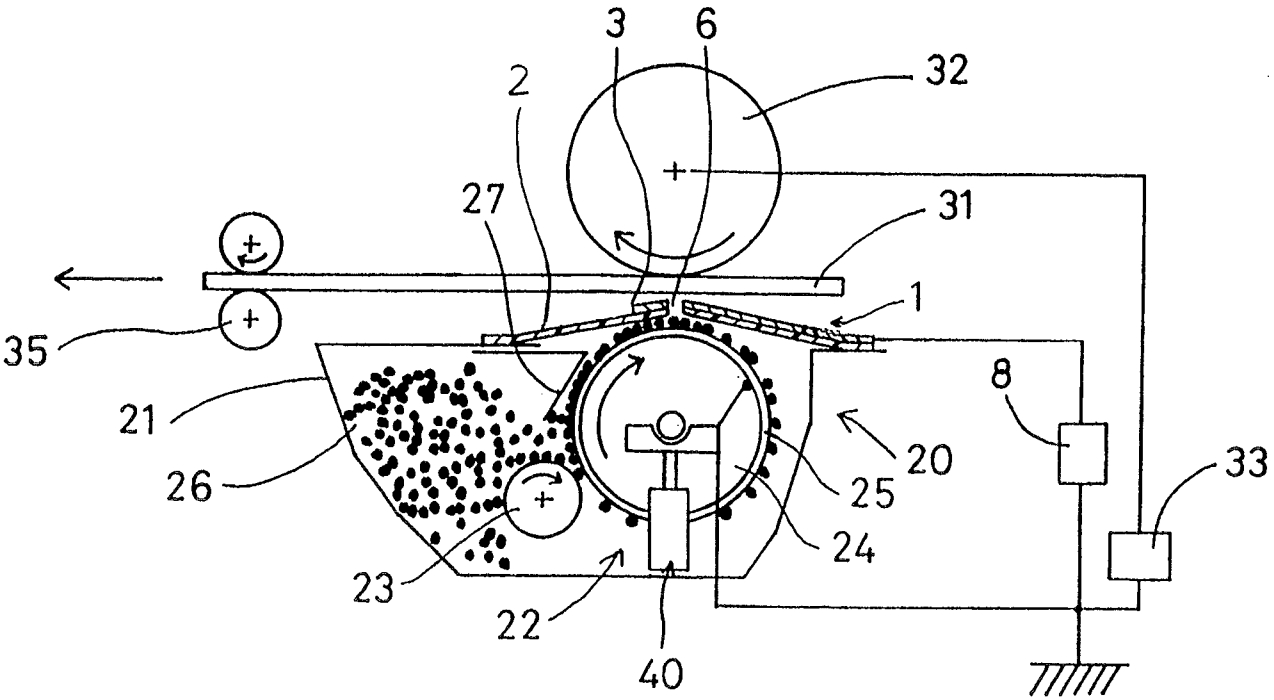
FIG. 4 is a cross-sectional view showing the structure of a second embodiment of the image recording apparatus of the invention.

FIG. 4 shows a second embodiment of the invention in which the aperture electrode 1 is fixed to the toner case 21 and the toner carry roller 22 is elastically supported by the toner case 21. A hydraulic or pneumatic piston or a spring may be used as a carry roller support mechanism 40.

Figure 5:
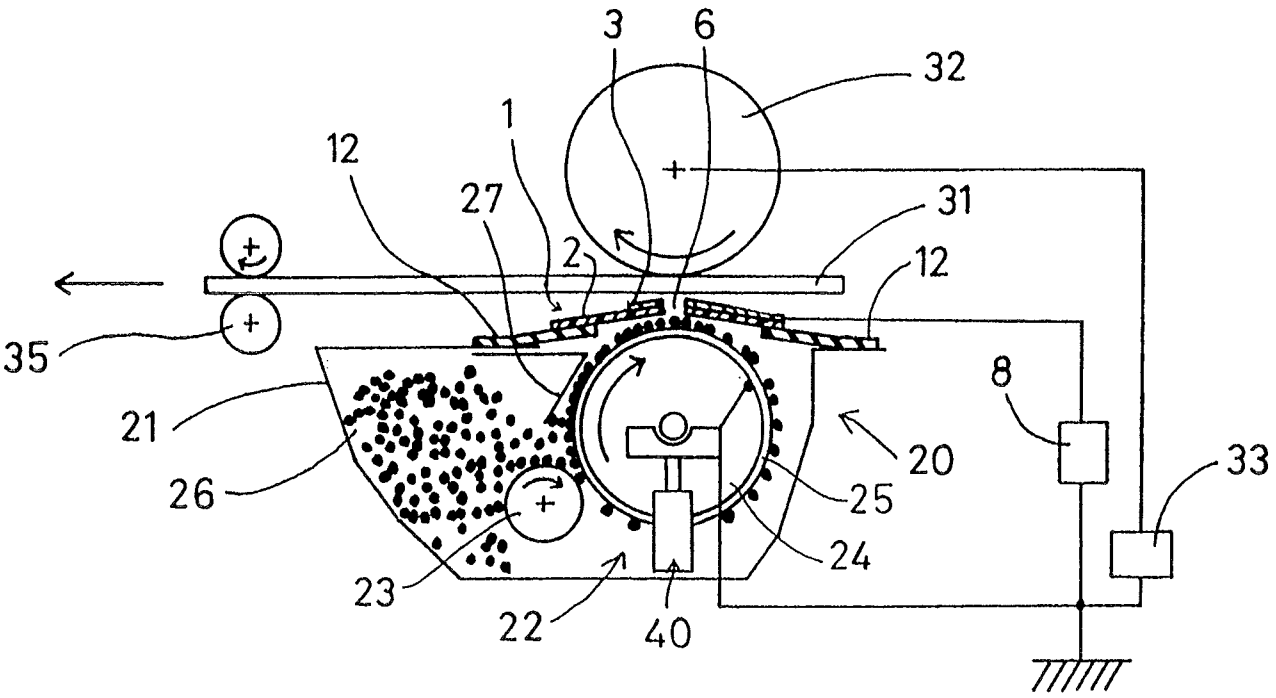
FIG. 5 is a cross-sectional view showing the structure of a third embodiment of the image recording apparatus of the invention.

FIG. 5 shows a third embodiment of the invention in which both of the aperture electrode I and the toner carry roller 22 are elastically supported by the toner case.

Figure 6:
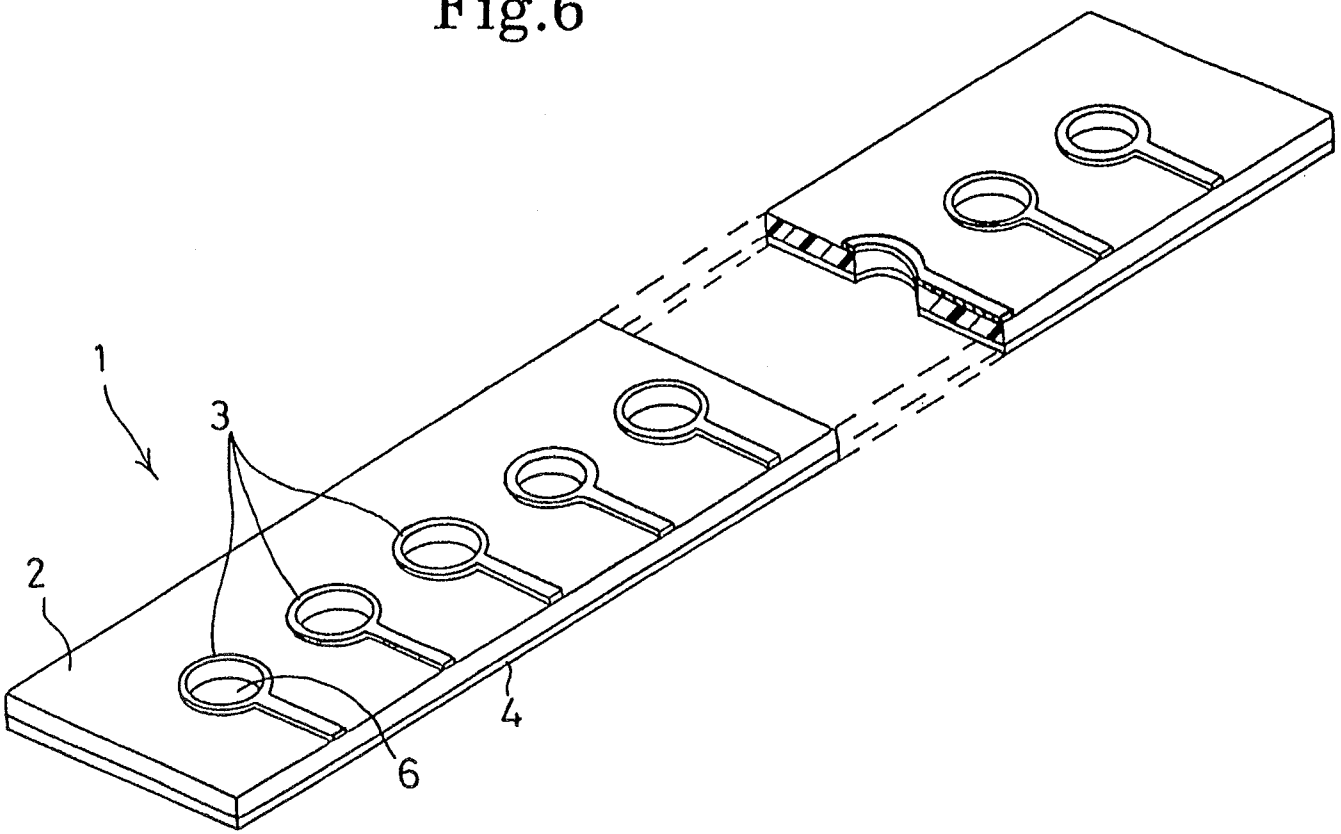
FIG. 6 is a detailed, perspective view of the structure of an aperture electrode used in a fourth embodiment of the invention.
Figure 7:
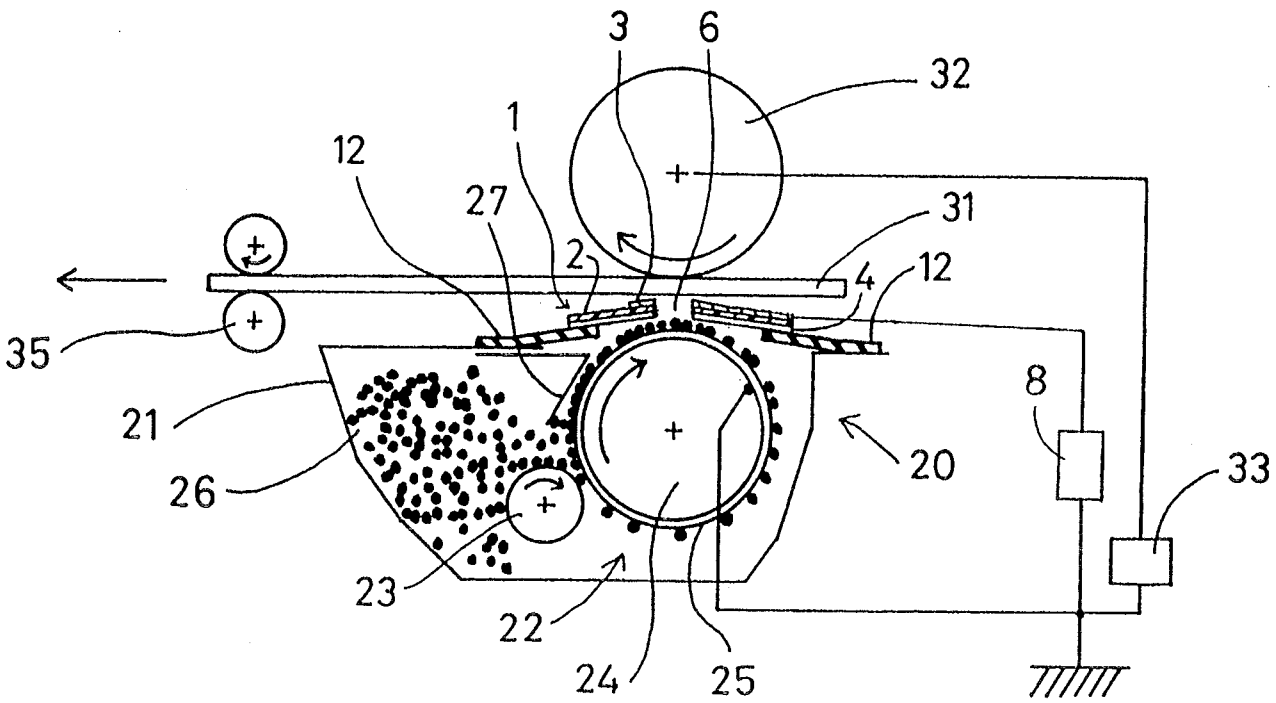
FIG. 7 is a cross-sectional view showing the structure of the fourth embodiment of the image recording apparatus according to the invention.

In the above embodiments, the aperture electrode 1 is provided with the control electrodes 3 on only one surface. However, as shown in FIG. 6, the aperture electrode 1 may be provided with a shielding electrode 4 at the other opposite surface thereof. The shielding electrode 4 serves to shield the electric field produced by the back electrode 32 so that the electric field is prevented from acting on the toner 26 at portions other than the portion on the sleeve 25 beneath the apertures 6. FIG. 7 shows an image recording apparatus using the above aperture electrode.

In the above embodiments, the toner carry roller 22 serving as the toner carrier comprises the sleeve 25 and the sponge roller 24. However, the invention is not limited to this structure. For example, the sleeve may be formed of a material other than Ni, such as copper, aluminum, Ni—Ti alloy or the like or a well-known conductive resin. The toner carry roller 22 itself may comprise a barrel-shaped member formed of the above material. In addition, the surface of the toner carry roller may be smooth or the surface roughness thereof may be adjusted in accordance with toner particle diameter, toner charge amount and toner carry mount.

What is claimed is:

1. An image forming apparatus, comprising:

a housing;

toner flow control means for modulating a flow of toner;

toner supply means having at least a toner supply member for supplying charged toner to said toner flow control means, wherein said toner supply member is disposed in contact with said toner flow control means, said toner supply means comprising a roller which is designed to be thicker at a middle portion than at both ends; and a counter electrode disposed at an opposite side to said toner supply means with respect to said toner flow control means.

2. The image forming apparatus according to claim 1, wherein at least one of said toner flow control means and said toner supply member is elastically supported by a housing so as to be elastically contacted with the other through the toner.

3. The image forming apparatus according to claim 2, further comprising first support means for elastically supporting said toner flow control means.

4. The image forming apparatus according to claim 3, wherein said first support means comprises two separated support members each having a longitudinal axis parallel to an axis of said toner supply means for supporting said toner flow control means so as to elastically contact said toner supply means by separating to apply tension to the toner flow control means in a direction transverse to said longitudinal axes of said support members to accommodate said toner supply means in order to maintain a uniform elastic contact between the toner supply means and the toner flow control means.

5. The image forming apparatus according to claim 2, further comprising second support means for elastically supporting said toner supply means.

6. The image forming apparatus according to claim 1, wherein said toner supply means is provided with a toner-layer restricting blade formed of an elastic material.

7. The image forming apparatus according to claim 1, wherein said toner supply means is provided with a toner-layer restricting blade which is formed of a rigid material and whose tip portion is designed in an arcuate shape which is coincident with a shape of a peripheral curved surface of said toner supply means.

8. The image forming apparatus according to claim 1, wherein said toner flow control means comprises an insulating member having at least one row of apertures and a plurality control electrodes, each said control electrode disposed on one surface side of said insulating member so as to surround a one of said apertures.

9. The image forming apparatus according to claim 8, wherein said insulating member is a thin film.

10. The image forming apparatus according to claim 8, wherein said toner flow control means is provided with a shielding electrode on an opposite surface of said insulating member to the surface on which said control electrodes are provided.

11. An image forming apparatus, comprising:

toner flow control means for modulating a flow of toner;

toner supply means having at least a toner supply member for supplying charged toner to said toner flow control means and a toner case for stocking toner, wherein said toner supply member is disposed in contact with said toner flow control means and comprises a roller which is thicker at a middle portion than at both ends;

support means disposed between said toner flow control means and said toner case to elastically mount said toner flow control means to said toner case; and a counter electrode disposed at an opposite side to said toner supply means with respect to said toner flow control means.

12. The image forming apparatus according to claim 11, further comprising toner supply means supporting means for elastically supporting said toner supply means.

13. The image forming apparatus according to claim 12, wherein said support means comprises two separated support members each having a longitudinal axis parallel to an axis of said toner supply means for supporting said toner flow control means so as to elastically contact said toner supply means by separating to apply tension to the toner flow control means in a direction transverse to said longitudinal axes of said support members to accommodate said toner supply means in order to maintain a uniform elastic contact between the toner supply means and the toner flow control means.

14. The image forming apparatus according to claim 13, wherein said toner supply means supporting means elastically supports said toner supply means in a direction orthogonal to a plane containing said longitudinal axes of said support members.

15. The image forming apparatus according to claim 11, wherein said toner supply means is provided with a toner-layer restricting blade formed of an elastic material.

16. The image forming apparatus according to claim 11, wherein said toner supply means is provided with a toner-layer restricting blade which is formed of a rigid material and whose tip portion is designed in an arcuate shape which is coincident with a shape of a curved peripheral surface of said toner supply member.

17. The image forming apparatus according to claim 11, wherein said toner flow control means comprises an insulating member having at least one row of apertures and a plurality of control electrodes, each of said control electrodes being disposed on one surface side of said insulating member so as to surround an associated one of said apertures.

18. The image forming apparatus according to claim 17, wherein said insulating member is a thin film.

19. The image forming apparatus according to claim 17, wherein said toner flow control means is provided with a shielding electrode on an opposite surface of said insulating member to the surface on which said control electrodes are provided.

* * * * *